US006859962B2

(12) United States Patent
Diak/Ghanem

(10) Patent No.: US 6,859,962 B2
(45) Date of Patent: Mar. 1, 2005

(54) QUICK CHANGE BED SHEET SET

(75) Inventor: Darlene Diak/Ghanem, Deerfield Beach, FL (US)

(73) Assignee: Worry Free Inventions, Inc., Deerfield Beach, FL (US)

( * ) Notice: Subject to any disclaimer, the term of this patent is extended or adjusted under 35 U.S.C. 154(b) by 0 days.

(21) Appl. No.: 10/395,462

(22) Filed: Mar. 21, 2003

(65) Prior Publication Data

US 2003/0177579 A1 Sep. 25, 2003

Related U.S. Application Data

(63) Continuation-in-part of application No. 09/976,797, filed on Oct. 12, 2001, now Pat. No. 6,651,278.

(51) Int. Cl.[7] ..... A47G 9/04

(52) U.S. Cl. ..... 5/499; 5/496; 5/484; 5/738; 5/923

(58) Field of Search ..... 5/482, 484, 486, 5/488, 496–500, 502, 699, 737, 738, 922, 923

(56) References Cited

U.S. PATENT DOCUMENTS

| | | | | | |
|---|---|---|---|---|---|
| 819,903 | A | * | 5/1906 | Maussner | 5/690 |
| 2,400,731 | A | * | 5/1946 | Armstrong | 5/500 |
| 2,907,055 | A | * | 10/1959 | Berman | 5/496 |
| 3,027,573 | A | * | 4/1962 | Bell, Jr. | 5/738 |
| 3,581,322 | A | * | 6/1971 | Marsico | 5/699 |
| 4,301,561 | A | * | 11/1981 | McLeod | 5/496 |
| 5,090,074 | A | * | 2/1992 | Scales et al. | 5/699 |
| 5,144,911 | A | * | 9/1992 | Moore et al. | 119/28.5 |
| 5,566,411 | A | * | 10/1996 | Eiler | 5/494 |
| 6,243,895 | B1 | * | 6/2001 | Amin | 5/498 |
| 6,381,778 | B1 | * | 5/2002 | Peterson | 5/497 |
| 6,631,529 | B1 | * | 10/2003 | Erickson | 5/738 |
| 6,757,923 | B2 | * | 7/2004 | Sopher et al. | 5/496 |
| 2002/0148047 | A1 | * | 10/2002 | Corzani et al. | 5/738 |
| 2003/0177579 | A1 | * | 9/2003 | Diak/Ghanem | 5/499 |
| 2004/0128764 | A1 | * | 7/2004 | McGrath et al. | 5/499 |
| 2004/0139552 | A1 | * | 7/2004 | Walters, Jr. | 5/737 |

* cited by examiner

*Primary Examiner*—Robert G. Santos
(74) *Attorney, Agent, or Firm*—Robert M. Downey PA

(57) ABSTRACT

A set of sheets includes an upper sheet with a top panel and a lower sheet with a bottom panel. In conjunction, the upper and lower sheets are sized, structured and configured to enclose a mattress. A waterproof panel is positioned between the upper sheet and the top of the mattress to protect the mattress from damaging exposure to moisture and liquids, including bodily fluids. In several embodiments, the upper sheet and waterproof panel are removable for washing and changing thereof while the lower sheet remains fitted to the mattress, thereby avoiding the need to lift or move the mattress when changing the sheets. The waterproof panel may be independently removable to selectively control air permeability of the sheets, and particularly the upper sheet. In a further embodiment, a minor waterproof panel is removably attachable in covering relation to a portion of the top surface of the upper sheet to protect the upper sheet and mattress from becoming soiled, and thereby extending the period of time between laundering and changing of the set of sheets.

2 Claims, 5 Drawing Sheets

QUICK CHANGE BED SHEET SET

This application is a continuation-in-part of patent application Ser. No. 09/976,797 filed on Oct. 12, 2001, now U.S. Pat No. 6,651,278, the contents of which are incorporated herein by reference.

BACKGROUND OF THE INVENTION

1. Field of the Invention

This invention relates to bed sheets that are adapted to facilitate ease of changing and replacing the sheets on a mattress and, more particularly, to a bed sheet set having an upper sheet portion and a lower sheet portion which, in conjunction, enclose the mattress and, further, wherein a waterproof panel is positionable between the upper sheet and the top of the mattress.

2. Discussion of the Related Art

There are numerous combinations of bed sheets which are designed to provide a quick and easy way to change bed linen. Most notably, it is known to provide a fitted sheet which is tailored to provide a tight, neat and wrinkle-free fit when secured to the mattress. The well known fitted sheet design provides elastic material around the corner edges to allow the corner edges to contract on the underside of the mattress in a manner which secures the fitted sheet in place so that the top surface of the sheet is pulled tight and flat on the top sleeping side of the mattress. When it is necessary to wash and change the sheets, the fitted sheet is fairly easy to remove from the mattress by pulling up on the corners. Replacing the fitted sheet on the mattress, however, is known to be problematic, especially if the sheet shrinks after washing and drying. It is often difficult to stretch the fitted sheet over the corners of the mattress in a manner which properly secures the elastic corner edges of the fitted sheet under the mattress. And, even if the fitted sheet is properly secured to the mattress, the corners are sometimes dislodged by the forces of body movement when sleeping.

The problems associated with fitted mattress sheets, having elastic corners, as described above, are of particular concern in the field of baby linen for crib mattresses. Specifically, the need to tuck the elastic edge corners of the fitted sheet around the underside of the mattress requires lifting of a crib mattress out from the crib each time the linens are changed. More importantly, fitted sheets can be easily dislodged from the mattress while an infant is in a crib. Oftentimes the person changing the crib sheets fails to properly secure the elastic corners of the sheet under the mattress, particularly if the fitted sheet shrinks from washing and does not fit easily over the mattress corners. And, even when properly secured to the mattress, fitted crib sheets can be pulled loose by an infant. This is particularly worrisome due to studies which have shown that many cases of Sudden Infant Death Syndrome (SIDS) are a result of smothering due to loose linen, blankets and/or pillows in a crib. For example, if the mattress sheet comes loose, there is danger of an infant becoming entangled or wrapped in the sheet when tossing and turning in the crib, which could possibly lead to suffocation.

The need to frequently change and wash bed linens is especially a concern with infants, small children and elderly bedridden individuals. Accordingly, in addition to the need for a quick and easy way to change bed linen, there is also a need, in many instances, for a linen accessory which provides waterproof properties in order to protect the mattress. With the aging of the population, there is an increasing number of people, both in institutions and at home, who spend much of their time bedridden. For many of these individuals, the bed is used for sleeping at night time and is also used for daily activities (e.g. phone calls, reading, watching television, etc.) while the person is awake. When sleeping, it may be desirable to use a protective sheet having waterproof properties to guard against damaging the mattress at night. However, most waterproof sheets do not provide good airflow through the fabric and become hot and uncomfortable over a period of time. In the instance an individual is confined to the bed during the day, it may be desirable to remove the waterproof sheet in order to provide better ventilation and increased comfort.

In the past, others have proposed various bed linen arrangements for application to a mattress. For instance, Blake U.S. Pat. Nos. 5,086,530 and 4,922,565 disclose a set of bed linen having a top panel that is moisture proof and a bottom fitted sheet that extends partially under a mattress to secure the bottom fitted sheet in the same manner as a conventional fitted sheet. The top panel and bottom sheet have cooperating fasteners that allow the top panel to be removed and replaced from the mattress without disturbing the fitted sheet. The top panel and bottom sheet do not enclose the mattress.

U.S. Pat. No. 6,067,677 to Reen et al. teaches a bed sheet in the form of a pouch with an open mouth. The pouch encloses a mattress. The sheet has a flap which is folded to close the open mouth. The sheet and the flap have cooperating fasteners to hold the flap in place.

U.S. Pat. No. 5,701,617 to Colby teaches a bottom bed sheet folded about a mattress. The bed sheet has two end portions of water permeable textile attached on opposite sides of a moisture resistant center portion. The moisture resistant portion has a textile portion superimposed and fastened to the water resistant portion. The fasteners are releasable.

Accordingly, there remains an urgent need in the art of bed linen for an improved bed sheet arrangement which provides for quick and easy changing of bed linen, while also providing a tight, neat, wrinkle-free and secure fit of the sheets to the mattress. There is a further need in the art for a bed sheet set which remains fitted and secured to the mattress during use and which provides for selective use of a waterproof panel to protect the underlying mattress from contact with moisture and liquids, including bodily fluids.

SUMMARY OF THE INVENTION

The present invention is directed to a set of sheets including an upper sheet with a top panel and a lower sheet with a bottom panel. In conjunction, the upper and lower sheets are sized, structured and configured to enclose a mattress. A waterproof panel is positioned between the upper sheet and the top of the mattress to protect the mattress from damaging exposure to moisture and liquids, including bodily fluids. In several embodiments, the upper sheet and waterproof panel are removable for washing and changing thereof while the lower sheet remains fitted to the mattress, thereby avoiding the need to lift or move the mattress when changing the sheets. The waterproof panel may be independently removable to selectively control air permeability of the sheets, and particularly the upper sheet. In a further embodiment, a minor waterproof panel is removably attachable in covering relation to a portion of the top surface of the upper sheet to protect the upper sheet and mattress from becoming soiled, and thereby extending the period of time between laundering and changing of the set of sheets.

OBJECTS AND ADVANTAGES OF THE INVENTION

With the foregoing in mind, it is a primary object of the present invention to provide a set of bed sheets structured and disposed to permit quick and easy changing of the bed linen without moving or disturbing the mattress.

It is a further object of the present invention to provide a set of bed sheets which may be used in a protective waterproof mode to protect the mattress and a comfort mode wherein air is permitted to permeate between the mattress and top sheet covering the mattress.

It is still a further object of the present invention to provide a set of bed sheets including a lower sheet which covers the bottom and sides of a mattress, an upper air-permeable sheet which releasably fastens to the lower sheet so that the upper and lower sheets enclose the mattress, and a less air-permeable waterproof panel which is selectively positionable between the upper sheet and the mattress.

It is still a further object of the present invention to provide a set of bed sheets which provides for the discretionary removal of the upper sheet, with or without removal of the waterproof panel, without removing the lower sheet from the mattress.

It is still a further object of the present invention to provide a set of bed sheets which is particularly suited for use on a crib mattress and wherein the set of bed sheets includes an upper sheet and a lower sheet which, in conjunction, enclose the crib mattress and remain secured thereto during use, without being dislodged, and further wherein the set of bed sheets includes a waterproof panel for selective positioning between the upper sheet and the top of the crib mattress.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
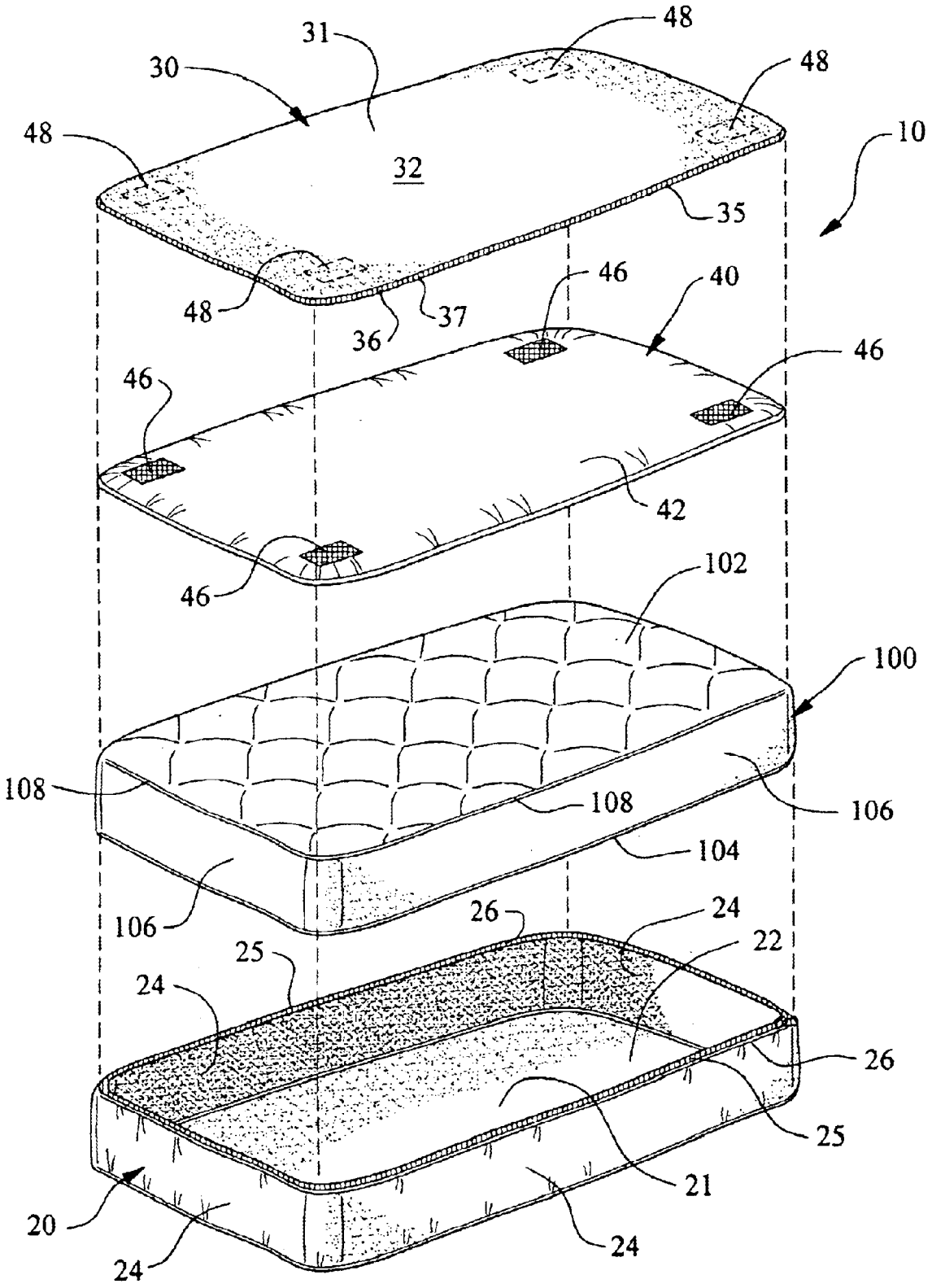
FIG. 1 is an exploded perspective view showing the separable components of the quick-change bed sheet set of the present invention in relation to a mattress, in accordance with one preferred embodiment thereof.
Figure 2:
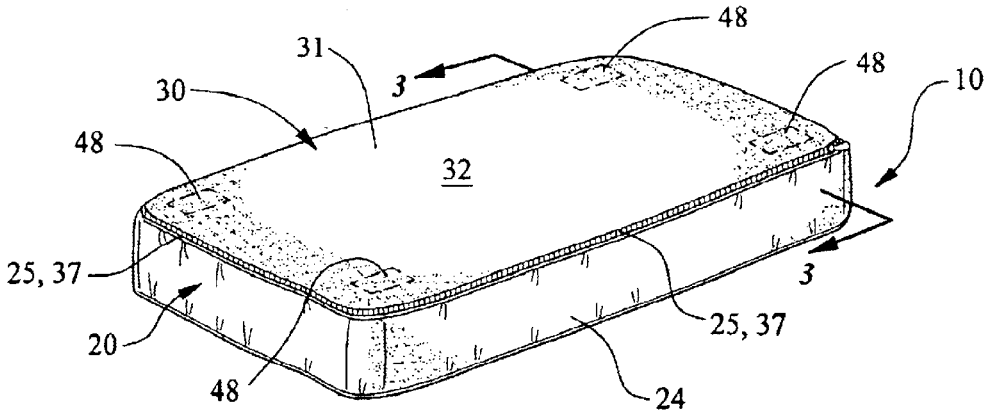
FIG. 2 is a top perspective view showing the quick-change bed sheet set of the embodiment of FIG. 1 secured to a mattress.

Referring to the several views of the drawings, several embodiments of the bed sheet set of the present invention are shown, wherein the bed sheet set is generally indicated as 10. In each of the embodiments, the bed sheet set 10 includes a lower sheet 20 and an upper sheet 30 which, in conjunction, are structured to enclose a mattress 100 having a top sleeping surface 102, a bottom side 104 and vertical sides 106.

A first preferred embodiment of the bed sheet set 10 is shown in FIGS. 1–3*a,* wherein the mattress 100 is partly encompassed by the lower sheet 20. The lower sheet 20 is preferably structured to include a rectangular main bottom panel 21 and upstanding sidewalls 24 about the periphery. The bottom panel 21 has an inner surface 22 and an outer surface 23. The juncture between the bottom panel 21 and side walls 24 may be of conventional construction with seamed edges to facilitate a snug, uniform fit about the bottom 102 and sides 106 of the mattress 100. The lower sheet 20 may be of a woven or knitted cotton or other conventional threads or yarns with a thread count determining the softness and air permeability of the panel.

A fastener 25 extends about the peripheral zone 26 on the sidewalls 24 of the lower sheet 20. The location of the fastener 25 is such that when the lower sheet 20 is fitted onto the mattress 100, the fastener 25 is disposed about the sides 106 of the mattress. The fastener 25 may be of a series of cooperating fasteners, such as opposite sides of a zipper, cooperating button and buttonholes, male and female snaps, or hook and loop fabric such as VELCRO or releasable cohesive materials. The fasteners should be of materials that will withstand numerous use and laundering cycles. In one preferred embodiment, the cooperating fasteners are defined by non-corrosive zippers which join the lower sheet 20 and upper sheet 30 about their entire correspondingly positioned peripheral edge zones to completely enclose the mattress 100 therein.

The upper sheet 30 is defined by an air-permeable main top panel 31 having a top outer surface 32, an inner surface 34, and a peripheral extremity 35 to completely overly the top sleeping surface 102 of the mattress 100. In a preferred embodiment, the peripheral extremity 35 of the upper sheet 30 extends partially down the sidewalls 106 of the mattress, just below the top peripheral edge 108 with the inner surface 34 facing the top sleeping surface 102 of the mattress 100. Alternatively, the upper sheet 30 may be sized to cover the top surface 102 of the mattress only, with the peripheral extremity of the upper sheet aligned with the top edge 108 or positioned just inside the top edge 108 of the mattress 100. There is a first fastener 37 attached to the peripheral edge zone 36 of the upper sheet 30. This fastener is the cooperating opposite part of the fastener 25 described above. A fly or flap 38 extends from the peripheral edge zone 36 to cover the cooperating fasteners 25, 37 of the lower and upper panels when the fasteners are attached. The upper sheet 30 may be of the same or similar material as the lower sheet 20 with similar thread count and air permeability. The threads or yarns may be natural or synthetic and, possibly, hydrophobic to increase the resistance of the panel to penetration of fluids.

The lower and upper sheets may be deployed, alone, during waking hours, when a person using the bed may be capable of managing the bodily functions. During this period, the air permeability of the bed sheet set 10 is normal without excessive heat buildup. The exposure of the upper sheet 30 will dictate changing on a regular basis, for example every three days or once a week. At such time, the cooperating fasteners 25, 37 will be unfastened, thereby allowing the upper sheet 30 to be removed and laundered while the lower sheet 20 remains in place and undisturbed.

As seen in FIGS. 1–3*b*, the bed sheet set 10 further includes a moisture proof major panel 40 adapted for positioning between the top sleeping surface 102 of the mattress 100 and the inner surface 34 of the top panel 31. The moisture proof major panel 40 is sized, structured and configured to cover at least a portion of the area of the top sleeping surface 102 and, in a preferred embodiment, the moisture proof major panel 40 covers the entire mattress top sleeping surface 102. The major panel 40 is structured to include an absorbent top side 42 and a waterproof underside 44. The absorbent top side 42 faces the inner surface 34 of the top panel 31 while the waterproof side 44 faces the top surface 102 of the mattress.

In one embodiment, the moisture proof major panel 40 is selectively positionable between the upper sheet and the mattress 100 and may be removed when desired to allow greater ventilation and to avoid excessive heat buildup. During sleeping hours, or when it is otherwise desired to protect the mattress, the major panel 40 can be inserted between the upper sheet 30 and mattress 100. As best seen in FIG. 1, cooperating releasable fasteners 46 and 48 are provided on the absorbent side 42 of the major panel 40 and the inner surface of the top panel 31, respectively, to facilitate attachment of the major panel 40 to the upper sheet 30 in a manner which prevents unwanted traveling or bunching up of the major panel 40 below the upper sheet 30 due to movement of the person lying on the bed or crib mattress.

Figure 3A:
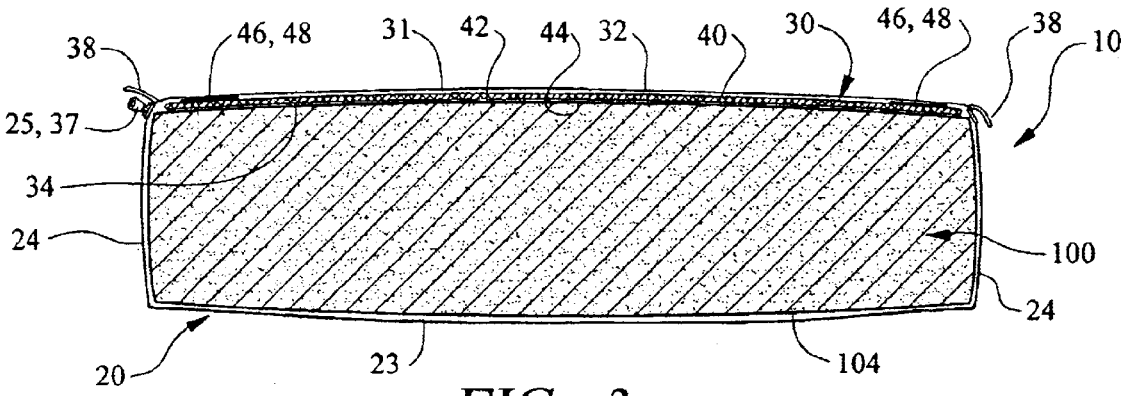
FIG. 3*a* is a cross-sectional view taken along the plane indicated by the line 3—3 in FIG. 2.
Figure 3B:
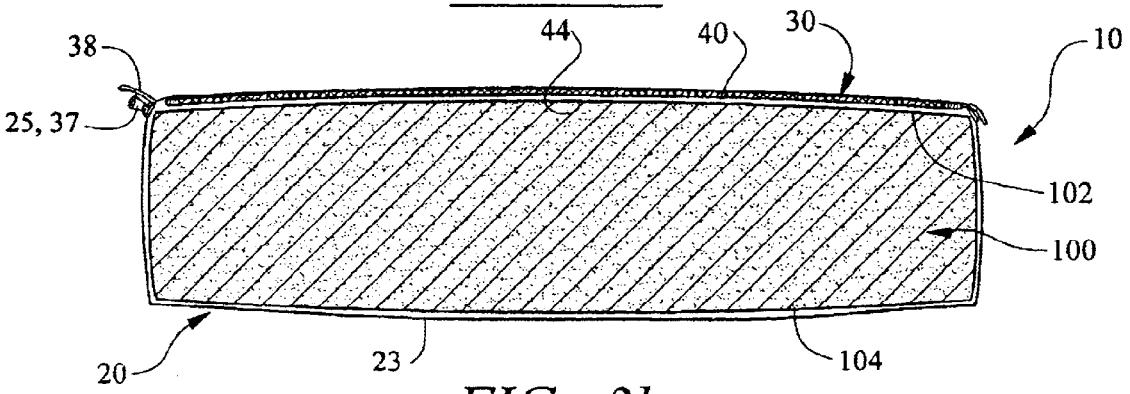
FIG. 3*b* is a cross-sectional view illustrating an alternative embodiment of the quick-change bed sheet set taken along the plane indicated by the line 3—3 in FIG. 2.

In another embodiment, as seen in FIG. 3*b*, the moisture proof major panel 40 is permanently sewn to the top panel 31, on the underside 34. In this instance, the major panel 40 may be stitched or otherwise attached to the inner surface 34 of the top panel 31 or, alternatively, sandwiched between two sheet layers making up the top panel 31 and stitched or otherwise secured in place.

In either embodiment, as described above, when it is necessary to change the upper sheet 30, both the upper sheet 30 and major panel 40 are removed from the mattress and lower sheet 20 by unfastening the cooperating fasteners 25, 37. The major panel 40 may then be laundered along with the upper sheet 30 or, in the embodiment of FIGS. 1–3*a*, if the major panel 40 has not been soiled it can be simply replaced on the top 102 of the mattress 100 for subsequent attachment to the inner surface 34 of the top panel 31 once the upper sheet 30 has been washed and dried.

Figure 4:
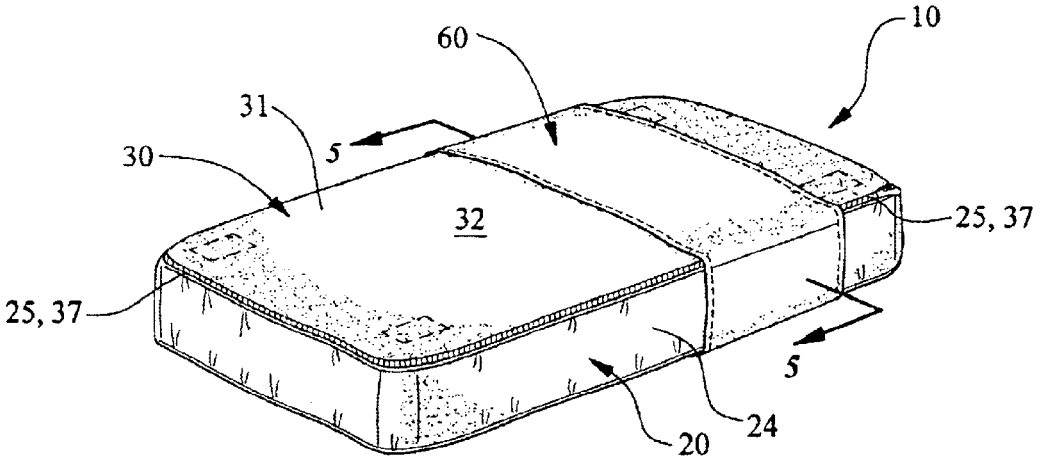
FIG. 4 is a top perspective view of the quick-change bed sheet set of the present invention in accordance with yet a further embodiment thereof, wherein a minor panel is secured about the mattress in covering relation to a portion of the upper sheet and sides of the lower sheet of the bed sheet set.
Figure 5:
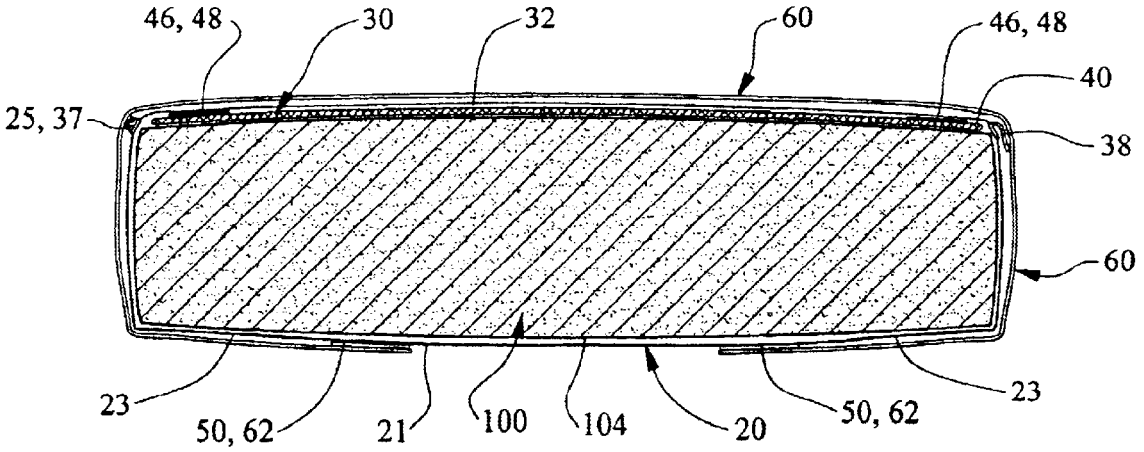
FIG. 5 is a cross-sectional view taken along the plane of the line indicated as 5—5 in FIG. 4.

In a further embodiment, as shown in FIGS. 4 and 5, the lower sheet 20 is provided with releasable fasteners 50 on the bottom outer surface 23. A minor panel 60, as shown in FIGS. 4 and 5, for covering a portion of the upper sheet 30 is shown with corresponding fastener elements 62 for releasably connecting to the fastener elements 50 on the bottom of the lower sheet 20. The minor panel 60 is waterproof with an absorbent layer sandwiched between opposing fabric panels which may be formed of cotton, synthetic or other conventional bed linen materials. Alternatively, the minor panel 60 may be made of a combination of an absorbent fabric on the top with a liquid impervious film backing on the bottom side. The minor panel 60 is intended to protect a remainder of the bed sheet set 10, including the upper sheet 30, major panel 40 (if used) and lower sheet 20, as well as the mattress 100, from liquid discharges, such as drooling, nasal discharges or beverage spills (e.g. leaking nursing bottles). The minor panel 60 may be of varying sizes to cover different portions of the top panel 31 of the upper sheet 30 in accordance with the particular needs of the user. The minor panel 60 helps to reduce the number of required bed linen changes and laundering, by protecting the remainder of the bed sheet set 10. When the minor panel 60 becomes soiled, it can be simply removed, by unfastening the cooperating fasteners 50, 62 on the underside of the lower sheet 20, below the mattress, and removing the minor panel 60 from the bed sheet set 10 and mattress 100. The minor panel 60 can then be conveniently laundered and replaced as needed. Further, the use of the minor panel 60 will allow the caregiver or the user to remove only the soiled minor panel portion of the bed sheet set 10 and replace it with another clean minor panel quickly and easily without disrupting the remainder of the bed sheet set 10 and mattress.

Figure 6:
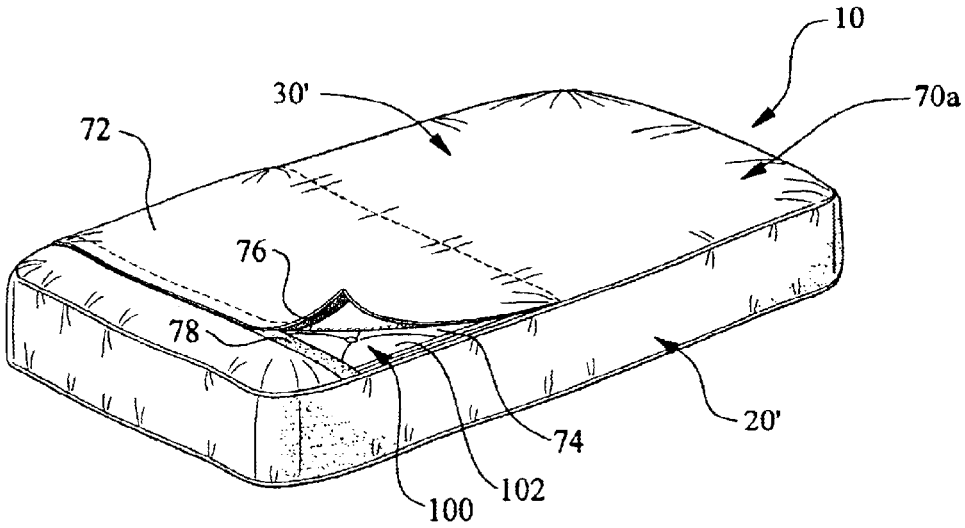
FIG. 6 is a top perspective view illustrating yet a further embodiment of the quick-change bed sheet set of the present invention secured to a mattress.
Figure 7:
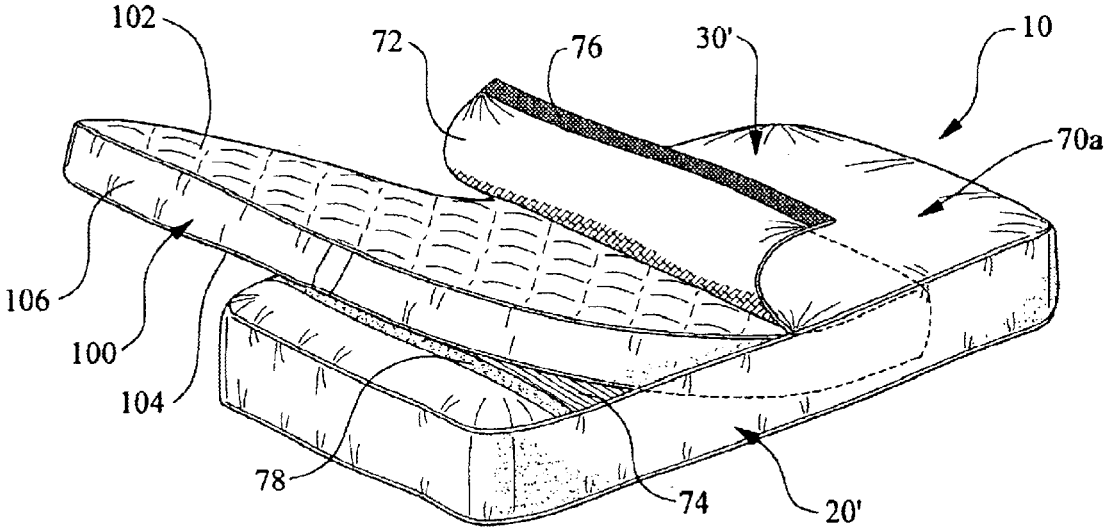
FIG. 7 is a top perspective view illustrating removal of the bed sheet set of FIG. 6 from the mattress.

Referring to FIGS. 6 and 7, yet a further embodiment of the bed sheet set 10 is shown wherein the lower sheet 20' and upper sheet 30' are permanently joined together in the form of a casing 70*a* which is sized, structured and configured to enclose the mattress 100. A flap portion 72 of the casing 70*a* unfolds to reveal an opening 74 which allows the end of the mattress to be slid within the interior of the bed sheet casing 70*a*. The casing 70*a* can then be pulled over and around the sides of the mattress 100 so that the mattress is completely tucked within the casing 70*a* defined by the combined lower and upper sheets 20', 30', respectively. The flap 72 can then be closed and secured with cooperating fasteners 76, 78, such as hook and loop fasteners, to completely encapsulate the mattress within the bed sheet enclosure. In this particular embodiment, the moisture proof major panel 40 may be used, as desired, and may be provided as an independent component, as shown and described in connection with FIGS. 1–3*a*, or, alternatively, the major panel 40 may be permanently stitched or otherwise attached to the inner side of the upper sheet 30'.

Figure 8:
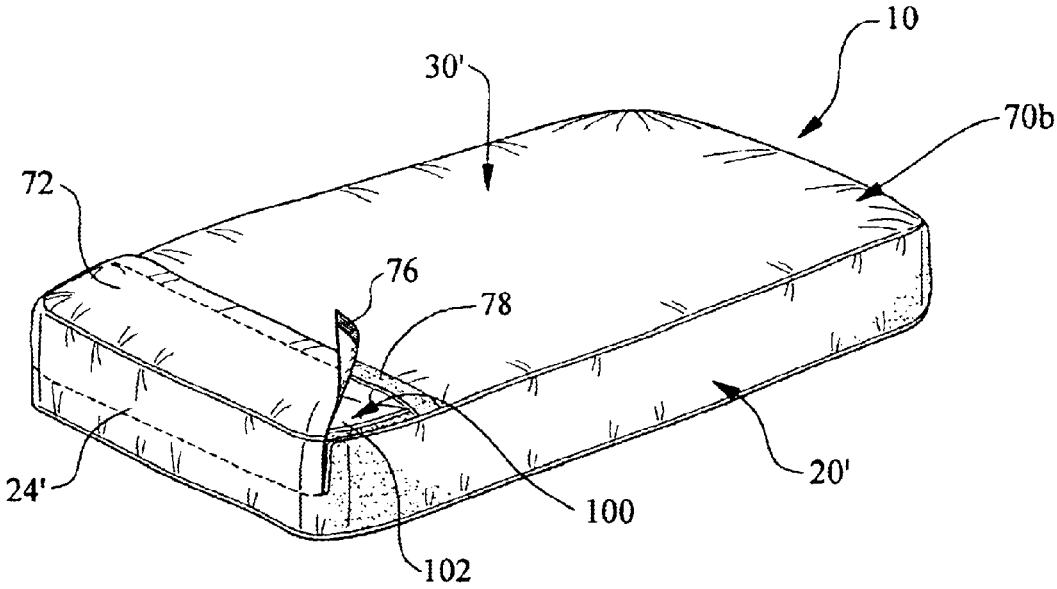
FIG. 8 is a top perspective view illustrating yet a further embodiment of the quick-change bed sheet set of the present invention shown secured to a mattress.

FIG. 8 shows a further embodiment of the bed sheet enclosure 70*b* defined by the combined lower sheet 20' and upper sheet 30' which are permanently secured together as an integral one-piece component, similar to the embodiment of FIGS. 6–7. In the embodiment of FIG. 8, the flap 72 is located at the end of the bed sheet enclosure, partially extending down the end sidewall 24', thereby providing a convenient opening 74 when the flap 72 is unfolded. This allows the bed sheet enclosure 70*b* to be slipped over the end of the mattress 100 and pulled along the length of the mattress so that the mattress is tucked and secured in enclosed relation within the bed sheet enclosure. The flap 72 can then be secured closed, using the cooperating releasable fasteners 76, 78, in the same general manner as described in connection with the embodiment of FIGS. 6–7. Again, the major panel 40 may be provided as a separate component and inserted between the upper sheet 30' and mattress 100, or, alternatively, the major panel 40 may be permanently stitched or otherwise secured under the inner side of the upper sheet 30' in the manner as described in the previous embodiments of FIGS. 1–3*b*.

The instant invention provides a method of safely securing a bed sheet set to a mattress while allowing for quick changing of the bed sheets for laundering as necessary comprising the steps of:

(a) providing the set of bed sheets with an absorbent porous lower sheet having an attached continuous fastener;

(b) securing the lower sheet about a mattress such that the fastener is disposed about the perimeter of the mattress;

(c) providing the bed sheet set with an absorbent porous upper sheet having a first attached continuous fastener;

(d) providing a moisture proof panel sized, structured and configured to cover at least a portion of the area of the top of the mattress;

(e) releasably securing the continuous fastener on the lower sheet to the continuous fastener on the upper sheet to enclose the mattress therein;

(f) selectively placing the moisture proof major panel between the upper sheet and the top of the mattress; and (g) removing the upper sheet and the major panel from the mattress and the lower sheet by unfastening the cooperating continuous fasteners on the upper sheet and the lower sheet, thereby allowing the upper sheet and/or the major panel to be laundered and replaced while the lower sheet and mattress remain stationery, in place and undisturbed.

Further, the instant invention provides a method of changing the air permeability of a set of bed sheets during use comprising the steps recited above, wherein the air permeability of the bed sheet set can be changed by selectively removing or inserting the moisture proof major panel between the upper sheet 30 and the mattress 100.

The invention further provides a method of extending the period of time between changes of a set of bed sheets comprising the steps of:

(a) providing the set with an absorbent porous lower sheet having an attached continuous fastener and a third attached fastener;

(b) securing the lower sheet about a mattress such that the fastener is disposed about the perimeter of the mattress;

(c) providing the set with an absorbent porous upper sheet having a first attached continuous fastener and a second attached fastener;

(d) releasably securing the continuous fastener on the lower sheet to the first continuous fastener on the upper sheet to enclose the mattress in encapsulated relation between the lower sheet and upper sheet;

(e) providing the bed sheet set with a waterproof major panel and a plurality of waterproof minor panels each having discreet edges and a fastener attached about their edges;

(f) selectively placing the major panel between the upper sheet and the top of the mattress and releasably securing a fastener on the waterproof major panel with the second fastener on the upper sheet;

(g) providing the bed sheet set with a plurality of minor waterproof panels each having a releasable fastener;

(h) releasably securing a fastener on one of the minor panels to the third attached fastener of the lower sheet with the minor panel extending over and covering a portion of the upper sheet;

(i) detaching one of the plurality of minor panels from the lower sheet while retaining the upper and lower sheets on the mattress; and (j) releasably securing the fastener of another of the plurality of minor panels to the third fastener of the lower sheet so that the minor panel extends over and covers the upper sheet, thereby extending the time between changes of the upper and lower sheet components of the bed sheet set.

While the instant invention has been shown and described in accordance with various preferred and practical embodiments thereof, it is recognized that departures from the instant disclosure are contemplated within the spirit and scope of the present invention which, therefore, should not be limited except as defined in the following claims as interpreted under the doctrine of equivalents.

What is claimed is:

1. A set of bed sheets for application to a mattress having a top, a bottom and sidewalls, said set of bed sheets comprising:

a lower sheet including a main bottom panel having an outer surface and an inner surface and said lower sheet being sized, structured and configured to encompass and cover the bottom of the mattress and at least a portion of the sidewalls thereof, and said lower sheet including a peripheral edge zone;

an upper sheet including a main top panel having an outer surface and an inner surface, said upper sheet being sized, structured and configured to encompass and cover the top of the mattress and said upper sheet including a peripheral edge zone;

said lower sheet and said upper sheet each including an element of a cooperating releasable fastener extending continuously along said respective peripheral edge zones, and said elements of said cooperating releasable fastener being structured and disposed for uninterrupted attachment of said upper sheet to said lower sheet continuously about said respective peripheral edge zones so that said upper and lower sheets enclose the mattress;

a moisture proof major panel adapted for positioning between the top of the mattress and said upper sheet, and said moisture proof major panel being sized, structured and configured to cover at least a portion of a total area of the top of the mattress, and said moisture proof major panel including an absorbent side and a waterproof side, said absorbent side of said moisture proof major panel facing said inner surface of said main top panel and said waterproof side of said moisture proof major panel facing the top of the mattress when said moisture proof major panel is positioned between said upper sheet and the mattress;

second elements of a releasable fastener on said inner surface of said main top panel; and cooperating second elements of a releasable fastener on said moisture proof major panel for releasable attachment with said second elements of said releasable fastener on said inner surface of said main top panel, whereby said upper sheet and said moisture proof panel may be selectively attached.

2. A set of bed sheets for application to a mattress having a top, a bottom and sidewalls, said set of bed sheets comprising:

a lower sheet including a main bottom panel having an outer surface and an inner surface and said lower sheet being sized, structured and configured to encompass and cover the bottom of the mattress and at least a portion of the sidewalls thereof;

an upper sheet including a main top panel having an outer surface and an inner surface, said upper sheet being sized, structured and configured to encompass and cover the top of the mattress;

elements of a cooperating releasable fastener on said lower sheet and said upper sheet, said elements of said cooperating releasable fastener being structured and disposed for continuous and uninterrupted attachment of said upper sheet to said lower sheet so that said lower sheet and said upper sheet, in conjunction, enclose the entire mattress;

a moisture proof major panel adapted for positioning between the top of the mattress and said upper sheet, and said moisture proof panel being sized, structured and configured to cover at least a portion of a total area of the top of the mattress, said moisture proof major panel including an absorbent side and a waterproof side, said absorbent side of said moisture proof panel facing said inner surface of said main top panel and said waterproof side of said moisture proof major panel facing the top of the mattress when said moisture proof major panel is positioned between said upper sheet and the mattress;

elements of a releasable fastener on said inner surface of said main top panel of said upper sheet; and cooperating elements of a releasable fastener on said moisture proof major panel for releasable attachment with said elements of said releasable fastener on said inner surface of said main top panel, whereby said upper sheet and said moisture proof major panel may be selectively attached with said moisture proof major panel positioned between said upper sheet and the top of the mattress.

* * * * *